US007741949B2

(12) United States Patent
Inoue et al.

(10) Patent No.: US 7,741,949 B2
(45) Date of Patent: Jun. 22, 2010

(54) VARISTOR

(75) Inventors: Tatsuya Inoue, Osaka (JP); Hidenori Katsumura, Hyogo (JP); Keiji Kobayashi, Osaka (JP)

(73) Assignee: Panasonic Corporation, Osaka (JP)

( * ) Notice: Subject to any disclaimer, the term of this patent is extended or adjusted under 35 U.S.C. 154(b) by 937 days.

(21) Appl. No.: 11/387,790

(22) Filed: Mar. 24, 2006

(65) Prior Publication Data

US 2006/0214764 A1 Sep. 28, 2006

(30) Foreign Application Priority Data

Mar. 25, 2005 (JP) ..... 2005-087849

(51) Int. Cl.
*H01C 7/10* (2006.01)

(52) U.S. Cl. ..... 338/21

(58) Field of Classification Search ..... 338/21
See application file for complete search history.

(56) References Cited

U.S. PATENT DOCUMENTS

| | | | | |
|---|---|---|---|---|
| 5,643,804 | A | 7/1997 | Arai et al. | |
| 6,087,923 | A | 7/2000 | Ahn et al. | |
| 6,090,435 | A * | 7/2000 | Ueno et al. | 427/79 |
| 6,172,590 | B1 * | 1/2001 | Shrier et al. | 338/20 |
| 6,239,687 | B1 * | 5/2001 | Shrier et al. | 338/21 |
| 6,339,367 | B1 * | 1/2002 | Takehana | 338/20 |
| 7,202,770 | B2 * | 4/2007 | Harris et al. | 338/21 |
| 7,283,032 | B2 * | 10/2007 | Inoue et al. | 338/21 |

FOREIGN PATENT DOCUMENTS

| | | |
|---|---|---|
| JP | 2-135702 | 5/1990 |
| JP | 6-333740 | 2/1994 |
| JP | 08-031616 | 2/1996 |
| JP | 2005-191205 | 7/2005 |
| JP | 2005-203479 | 7/2005 |
| JP | 2005-260137 | 9/2005 |
| JP | 2005-294673 | 10/2005 |

OTHER PUBLICATIONS

Chinese Office Action, issued in Chinese Patent Application No. CN 2006100718991 dated on Mar. 6, 2009.

* cited by examiner

*Primary Examiner*—Elvin G Enad
*Assistant Examiner*—Joselito Baisa
(74) *Attorney, Agent, or Firm*—McDermott Will & Emery LLP

(57) ABSTRACT

A varistor includes a ceramic insulating substrate, a varistor section having an outer surface, and first and second external electrodes provided on the outer surface of the varistor section. The varistor section includes a varistor layer on the ceramic insulating substrate, first and second internal electrodes, and first and second via-conductors embedded in the varistor layer and exposing from the varistor layer. The second internal electrode has a portion facing the first internal electrode. The first internal electrode and the portion of the second internal electrode sandwiches at least a portion of the varistor layer. The first and second via-conductors are connected to the first and second internal electrodes, respectively. The first and second external electrodes are connected to the first and second via-conductors, respectively. This varistor has a small thickness and a large mechanical strength.

2 Claims, 6 Drawing Sheets

VARISTOR

FIELD OF THE INVENTION

The present invention relates to a varistor for protecting electronic devices from an electrostatic discharge and a surge voltage.

BACKGROUND OF THE INVENTION

Electronic devices, such as a portable telephone, have recently had small sizes and high performance, and accordingly had circuits which are arranged densely and which have withstand voltages decrease. This increases breakdown of the circuits caused by an electrostatic discharge pulse generated when a human body contacts terminals of the electronic devices.

In order to prevent the circuits from the breakdown caused by the electrostatic discharge pulse, a conventional laminated chip varistor disclosed in Japanese Patent Laid-Open Publication No. 08-31616 is provided between a ground and a line to which the electrostatic discharge pulse are supplied. The varistor causes the electrostatic discharge pulse to bypass the circuits to reduce a voltage applied to the circuits.

Electronic devices have small sizes and high performance and accordingly, the number of components to address the electrostatic discharge pulse. Particularly for varistors, not only a single varistor but also a varistor array including plural varistors are demanded. Such varistors are demanded to be thin to provide small and thin electronic devices.

Zinc-oxide based material, which the conventional laminated chip varistor disclosed in Japanese Patent Laid-Open Publication No. 08-31616 employs, has a small strength to bending. The conventional varistor necessarily has a certain thickness to provide a predetermined strength, thus hardly having a small thickness. For example, a commercially-available laminated chip varistor having a length of about 1.6 mm and a width of 0.8 mm needs to have a thickness larger than 0.8 mm. If having a thickness smaller than this, the laminated chip varistor needs to have a smaller size, thus hardly providing a thin and large varistor. Accordingly, it is difficult to provide a varistor array including a large number of varistors.

SUMMARY OF THE INVENTION

A varistor includes a ceramic insulating substrate, a varistor section having an outer surface, and first and second external electrodes provided on the outer surface of the varistor section. The varistor section includes a varistor layer on the ceramic insulating substrate, first and second internal electrodes, and first and second via-conductors embedded in the varistor layer and exposing from the varistor layer. The second internal electrode has a portion facing the first internal electrode. The first internal electrode and the portion of the second internal electrode sandwiches at least a portion of the varistor layer. The first and second via-conductors are connected to the first and second internal electrodes, respectively. The first and second external electrodes are connected to the first and second via-conductors, respectively.

This varistor has a small thickness and a large mechanical strength.

DETAILED DESCRIPTION OF THE PREFERRED EMBODIMENTS

Exemplary Embodiment 1

Figure 1:
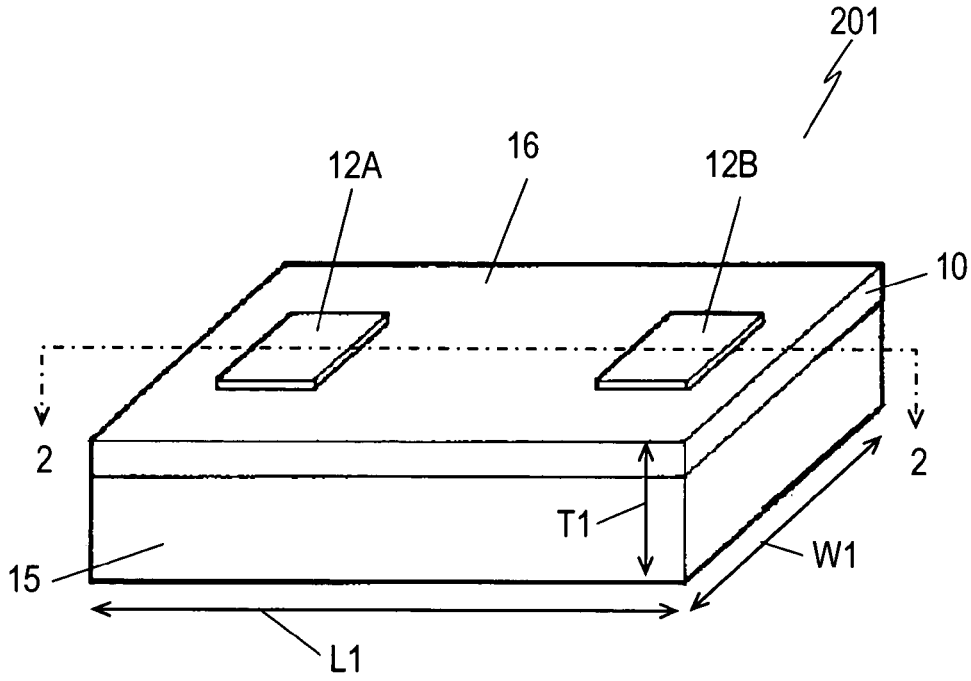
FIG. 1 is a perspective view of a varistor in accordance with Exemplary Embodiment 1 of the present invention.
Figure 2:
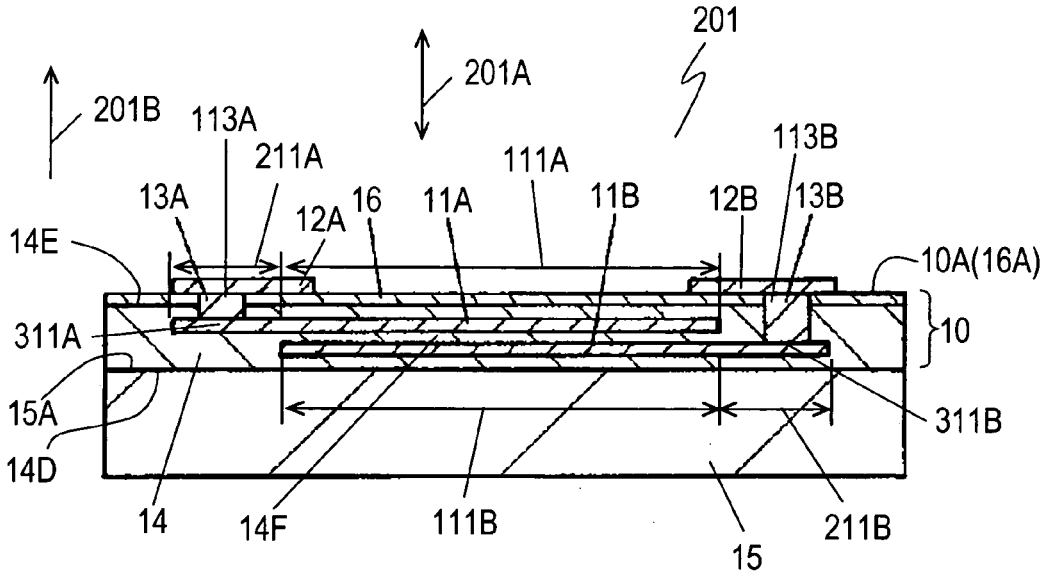
FIG. 2 is a sectional view of the varistor at line 2-2 shown in FIG. 1.

FIG. 1 is a perspective view of varistor 201 in accordance with Exemplary Embodiment 1 of the present invention. FIG. 2 is a sectional view of varistor 201 at line 2-2 shown in FIG. 1. Varistor 201 includes ceramic insulating substrate 15, varistor section 10 provided on surface 15A of ceramic insulating substrate 15, and external electrodes 12A and 12B, first and second external electrodes, provided on outer surface 10A of varistor section 10. Varistor section 10 includes varistor layer 14, internal electrode 11A, i.e., a second internal electrode, provided in varistor layer 14, internal electrode 11B, i.e., a first internal electrode, embedded in varistor layer 14, via-conductors 13B and 13A, i.e., first and second via-conductors, embedded in varistor layer 14, and protective layer 16. Internal electrode 11A and ceramic insulating substrate 15 sandwich internal electrode 11B between electrode 11A and substrate 15. That is, internal electrode 11B is provided between ceramic insulating substrate 15 and internal electrode 11A. Varistor layer 14 has surface 14D positioned on surface 15A of ceramic insulating substrate 15, and surface 14E opposite to surface 14D. Protective layer 16 is provided on surface 14E of varistor layer 14. Outer surface 16A of protective layer 16 is outer surface 10A of varistor section 10. In other words, external electrodes 12A and 12B are provided on outer surface 16A of protective layer 16.

Next, varistor section 10 will be described below. Internal electrodes 11A and 11B face each other in direction 201A perpendicular to surface 15A of ceramic insulating substrate 15. Internal electrode 11A has portion 111A which faces internal electrode 11B, and portion 211A which does not face internal electrode 11B. Internal electrode 11B has portion 111B which faces internal electrode 111A, and portion 211B which does not face internal electrode 11A. In other words, portion 111A of internal electrode 11A faces portion 111B of internal electrode 11B. Via-conductor 13A has portion 113A connected to internal electrode 11A and exposing from internal electrode 11A in a direction opposite to insulating substrate 15. Portion 113A of via-electrode 13A exposes from varistor layer 14 and varistor section 10. Via-conductor 13B has portion 113B connected to internal electrode 11B and extending from internal electrode 11B in a direction opposite to insulating substrate 15. Portion 113B of via-electrode 13B exposes from varistor layer 14 and varistor section 10. External electrode 12A is connected to portion 113A of via-conductor 13A. External electrode 12B is connected to portion 113B of via-conductor 13B. Ceramic insulating substrate 15, varistor layer 14, internal electrodes 11A and 11B, protective layer 16, and via-conductors 13A and 13B are sintered unitarily. Portion 14F of varistor layer 14 is provided between internal electrodes 11A and 11B facing each other, and provides characteristics of varistor to have varistor 201 functions as a varistor. In other words, internal electrode 11A has portion 111A facing internal electrode 11B positioning at least a portion (portion 14F) of varistor layer 14 between portion 111A and electrode 11B.

Internal electrode 11A has joint portion 311A connected to via-conductor 13A. Internal electrode 11B has joint portion 311B connected to via-conductor 13B. Internal electrode 11B is not positioned directly under joint portion 311A. In other words, joint portion 311A of internal electrode 11A is positioned in portion 211A of internal electrode 11A. Internal electrode 11A is not positioned directly above joint portion 311B of internal electrode 11B. In other words, joint portion 311B of internal electrode 11B is positioned in portion 211B of internal electrode 11B.

Ceramic insulating substrate 15 has a large mechanical strength. Varistor section 10 is sintered unitarily on ceramic insulating substrate 15, thereby allowing varistor 201 to have a small thickness and a large mechanical strength. Portion 14F of varistor layer 14 between internal electrodes 11A and 11B provide varistor 201 with characteristics as a varistor, thereby providing the varistor with small variations of electrical characteristics and excellent characteristics and quality.

Internal electrode 11B is not positioned directly under joint portion 311A of internal electrode 11A. This structure prevents internal electrodes 11A and 11B from contacting each other even when via-conductor 13A projects downwardly, i.e. toward insulating substrate 15, accordingly reducing failures, such as short-circuiting, of varistor 201.

Figure 3:
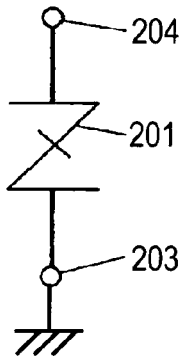
FIG. 3 is an equivalent circuit diagram of the varistor in accordance with Embodiment 1.

FIG. 3 is an equivalent circuit diagram of varistor 201. External electrodes 12A and 12B are electrically equivalent to each other, thus allowing one of external electrodes 12A and 12B to be used as input/output external electrode 204 for input and output and allowing the other one of external electrodes 12A and 12B to be used as grounding external electrode 203 for grounding.

Figure 4:
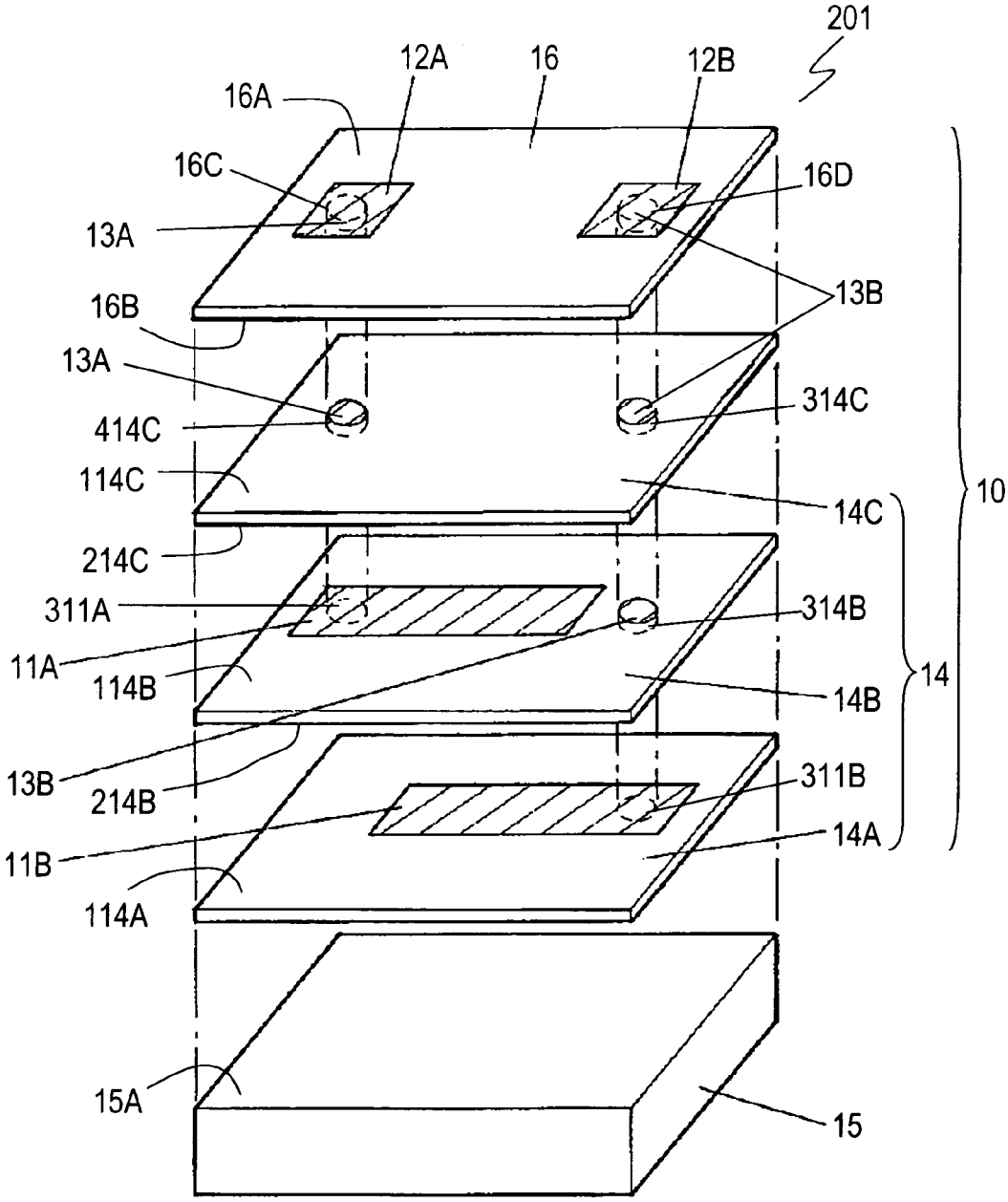
FIG. 4 is an exploded perspective view of the varistor in accordance with Embodiment 1.

Next, a method of manufacturing varistor 201 will be described below. FIG. 4 is an exploded perspective view of varistor 201.

First, plural zinc-oxide green sheets containing ceramic powder made mainly of zinc oxide and containing organic binder are prepared. A glass-ceramic green sheet made mainly of glass-ceramic powder and containing alumina, brosilicate glass, and organic binder is prepared. These green sheets have thicknesses of about 30 μm. The zinc-oxide green sheets are sintered to provide varistor layer 14, and the glass-ceramic green sheet is sintered to provide protective layer 16.

As shown in FIG. 4, varistor layers 14A, 14B, and 14C are attached to provide varistor layer 14.

Silver paste is screen-printed on surface 114A of the zinc oxide green sheet to be varistor 14A, providing a conductive layer to be internal electrode 11B.

Silver paste is screen-printed on surface 114B of the zinc oxide green sheet to be varistor 14B, providing a conductive layer to be internal electrode 11A. Through-hole 314B is formed in this zinc oxide green sheet so that through-hole 314B is positioned on joint portion 311B of internal electrode 11B. Through-hole 314B is filled with silver paste, providing via-conductor 13B. Then, the zinc oxide green sheet to be varistor layer 14B is stacked on surface 114A of the zinc oxide green sheet to be varistor layer 14A and on the conductive layer to be internal electrode 11B, so that surface 214B opposite to surface 114B of varistor layer 14B is positioned on surface 114A.

Through-holes 314C and 414C is formed in the zinc oxide green sheet to be varistor 14C so that through-hole 414C is positioned on joint portion 311A of internal electrode 11A, and through-hole 314C is positioned on through-hole 314B in sheet 14B. Through-hole 314C is filled with silver paste to provide via-conductor 13B. Through-hole 414C is filled with silver paste to provide via-conductor 13A. Then, the zinc oxide green sheet to be varistor layer 14C is stacked on surface 114B of the zinc oxide green sheet to be varister layer 14B and on the conductive layer to be internal electrode 11A, so that surface 214C of the zinc oxide green sheet is positioned on surface 114B.

Through-holes 16C and 16D are formed in a glass-ceramic green sheet to be protective layer 16 so that through-hole 16C and 16D are positioned on through-holes 414C and 314C, respectively. Through-holes 16C and 16D are filled with silver paste to provide via-conductors 13A and 13B, respectively. Silver paste is screen printed on surface 16A of the glass-ceramic green sheet to cover through holes 16C and 16D, providing conductive layers to be external electrodes 12A and 12B, respectively. The glass-ceramic green sheet is stacked on surface 114C of the zinc oxide green sheet to be varistor layer 14C, so that surface 16B opposite to surface 16A of the glass-ceramic green sheet is positioned on surface 114C, thus providing a laminated body to provide varistor section 10.

Next, the laminated body is bonded on surface 15A of ceramic insulating substrate 15 made of alumina, providing a laminated block.

Then, the laminated block is heated in atmospheric air for removing the binder, and is heated to a temperature of 930° C. in atmospheric air to be sintered unitarily to provide a sintered body. External electrodes 12A and 12B of the sintered body are plated with nickel and tin, and then, the sintered body is cut, thus providing varistor 201 having a predetermined size.

According to Embodiment 1, ceramic insulating substrate 15 has a thickness of about 180 μm. The conductive layers to be internal electrodes 11A and 11B has thicknesses of about 2.5 μm. The silver paste used for providing via-conductors 13A and 13B contains 85 wt. % of silver. Each of through-holes 314B, 314C, 414C, 16C and 16D to be filled with the silver paste has a diameter of 120 μm. A large number of conductive layers are printed in rows and columns of an array so as to provide the shape shown in FIG. 4 after the sintered body is cut.

300 pieces of samples of varistor 201 were prepared. Each of the samples had length L1 of about. 1.6 mm, width W1 of about 0.8 mm, and thickness T1 of about 0.25 mm. These samples do not cause any short-circuiting failure between external electrodes 12A and 12B. In each of these samples, a varistor voltage, a voltage between external electrodes 12A and 12B provided while a current of 1 mA flows between electrodes 12A and 12B, ranges from about 22V to about 30V.

Figure 5:
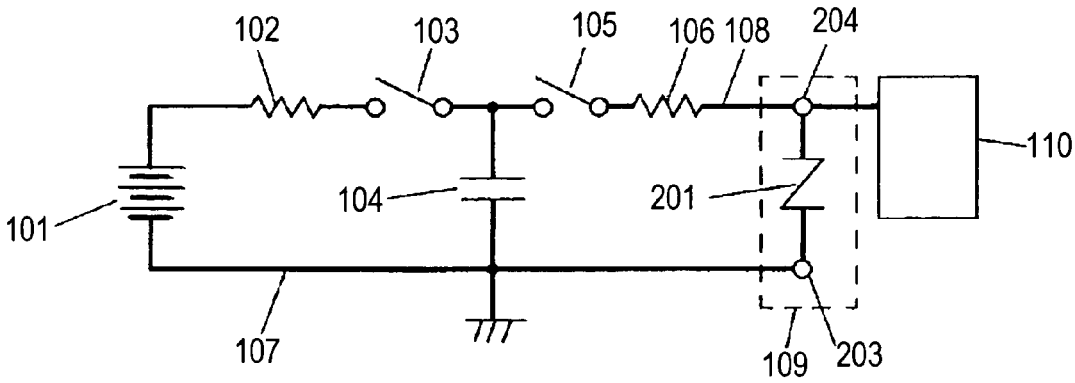
FIG. 5 shows a circuit for testing the varistor in accordance with Embodiment 1.

Next, the samples of varistor 201 prepared in above were subjected to an electrostatic discharge test and evaluated. FIG. 5 shows a circuit for testing the samples of varistor 201. Switch 103 is closed to apply a predetermined voltage from DC power source 101 via resistor 102 to store an electric charge in capacitor box 104 having a capacitance of 150 pF. Then, switch 103 is opened. Switch 105 is closed to apply the electric charge, as electrostatic discharge pulse, stored in capacity box 104 to sample 109 of varistor 201 and protected device 110 through resistor 106 and signal line 108. Input/output external electrode 204 of sample 109 of varistor 201 was connected to signal line 108, and grounding external electrode 203 was connected to ground line 107.

Sample 109 of varistor 201 allowed the electrostatic discharge pulse flowing signal line 108 to bypass protected device 110 and reduced a voltage applied to device 110. A voltage across signal line 108 and ground line 107 at the flowing of the electrostatic discharge pulse was measured to evaluate an effect of reducing the voltage of sample 109.

A comparative sample of a laminated varistor having a varistor voltage of 27V was connected between signal line 108 and ground line 107, and an effect of reducing a voltage caused by the electrostatic discharge pulse was also evaluated. When sample 109 was not connected, a peak voltage of the electrostatic discharge pulse was 8 kV.

When the comparative sample of the laminated varistor was connected between signal line 108 and ground line 107, the peak voltage applied to protected device 110 was about 220V. On the other hand, when the sample of the laminated varistor of Embodiment 1 was connected, the peak voltage applied to protected equipment 110 was about 230V. In other words, although varistor 201 and the comparative sample of the laminated varistor have structures completely different from each other, they have the same effect for reducing the voltage caused by the electrostatic discharge pulse.

A sample of a varistor which includes a varistor section having a length of about 1.6 mm, a width of about 0.8 mm, and a thickness of about 0.25 mm and which does not include ceramic insulating substrate 15 was prepared. This sample was too thin to have a sufficient mechanical strength of zinc oxide ceramics, and accordingly caused defects, such as cracks and chips, when external electrodes 12A and 12B were formed and their characteristics were measured. Thus, the sample did not provide a varistor.

As described above, varistor 201 of Embodiment 1 can be extremely thin, and has sufficient functions as a varistor to protect devices from an electrostatic discharge and a surge voltage. Varistor 201 further has no failures, such as short-circuiting, and small variations in its varistor voltage.

Exemplary Embodiment 2

Figure 6:
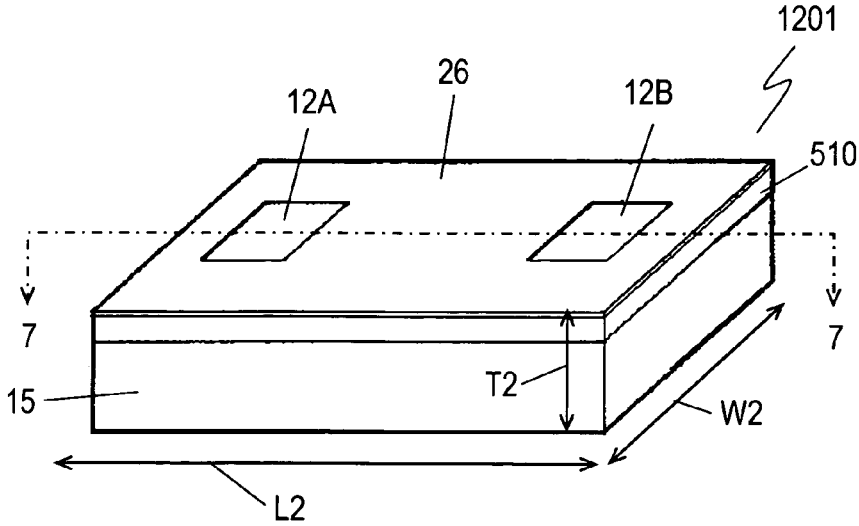
FIG. 6 is a perspective view of a varistor in accordance with Exemplary Embodiment 2 of the invention.
Figure 7:
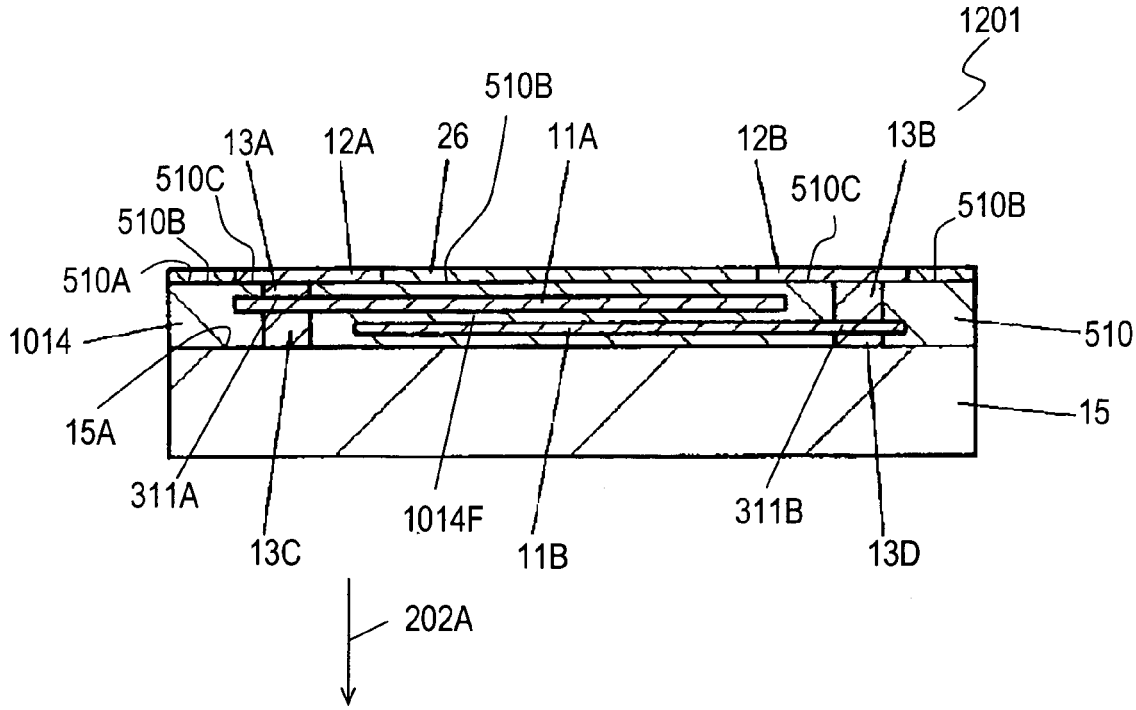
FIG. 7 is a sectional view of the varistor at line 7-7 shown in FIG. 6.
Figure 8:
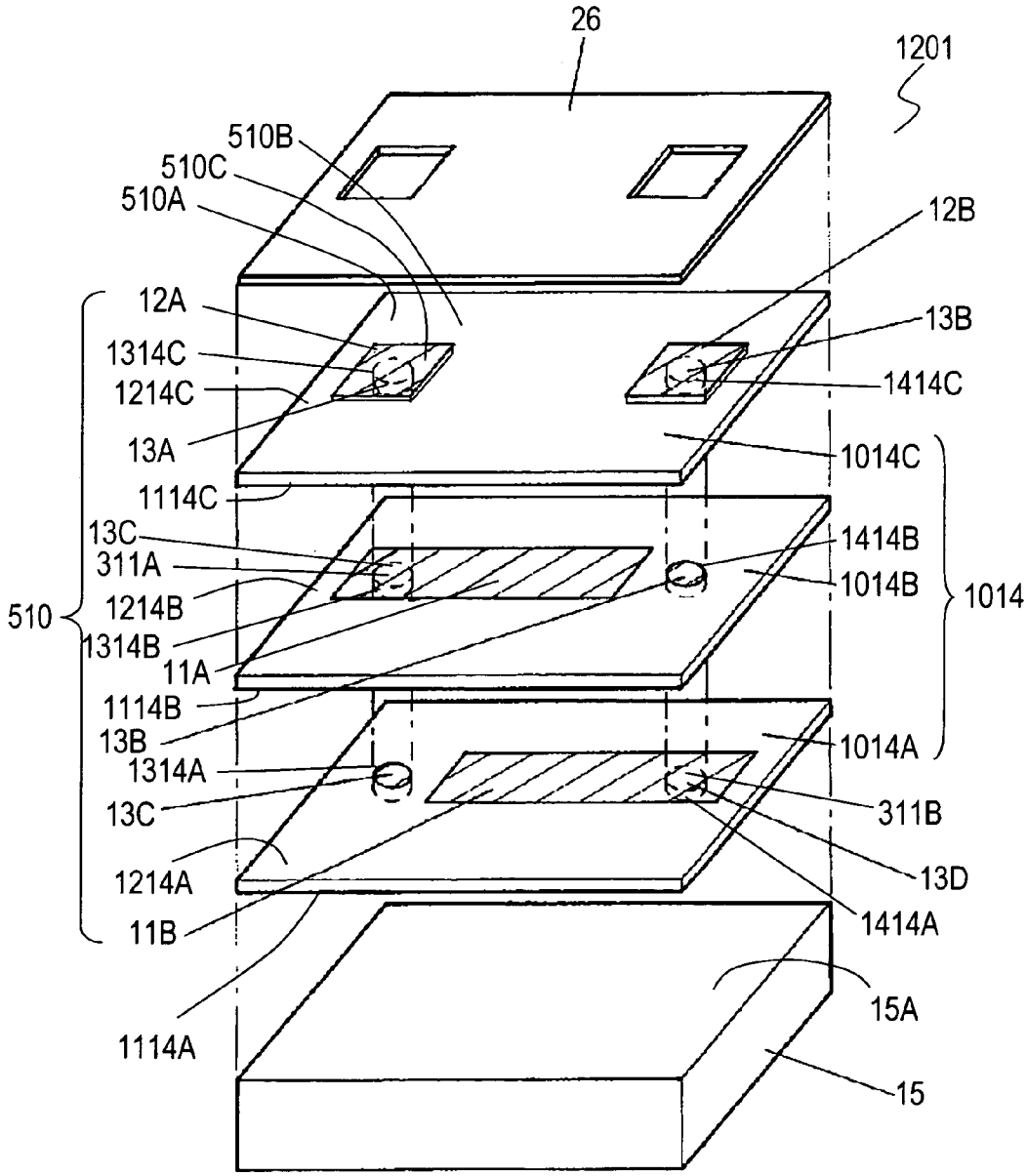
FIG. 8 is an exploded perspective view of the varistor in accordance with Embodiment 2.

FIG. 6 is a perspective view of varistor 1201 in accordance with Exemplary Embodiment 2 of the present invention. FIG. 7 is a sectional view of varistor 1201 at line 7-7 shown in FIG. 6. FIG. 8 is an exploded perspective view of varistor 1201. Elements identical to those of in varistor 201 of Embodiment 1 shown in FIGS. 1, 2, and 4 are denoted by the same reference numerals, and their descriptions are omitted.

Varistor 1201 includes varistor section 510 instead of varistor section 10 of Embodiment 1, and further includes protective layer 26 provided on surface 510A of varistor section 510. Varistor section 510 includes varistor layer 1014, internal electrodes 11A and 11B embedded in varistor layer 1014, and via-conductors 13A and 13B embedded in varistor layer 1014, and further includes via-conductor 13C, i.e., a fourth via-conductor, embedded into varistor layer 1014 and via-conductor 13D, i.e., a third via-conductor, embedded into varistor layer 1014. Ceramic insulating substrate 15, varistor layer 1014, internal electrodes 11A and 11B, and via-conductors 13A, 13B, 13C, and 13D are sintered unitarily to provide a ceramic sintered body. External electrodes 12A and 12B are provided on surface 510A, an outer surface of varistor 510. Portion 510B of surface 510A other than portion 510C having external electrodes 12A and 12B thereon is covered with protective layer 26. Portion 1014F between external electrodes 11A and 11B facing each other provides the varister with characteristics functioning as a varistor. Internal electrodes 11A and 11B are connected to external electrodes 12A and 12B through via-conductors 13A and 13B, respectively.

Via-conductor 13C reaches ceramic insulating substrate 15 directly under via-conductor 13A. In other words, internal electrode 11A is connected to via-conductor 13A at joint portion 311A. Via-conductor 13C is provided between joint portion 311A and ceramic insulating substrate 15 and is connected to joint portion 311A and ceramic insulating substrate 15. Via-conductor 13C extends from joint portion 311A of internal electrode 11A in direction 202A opposite to via electrode 13A. Via-conductor 13D reaches ceramic insulating substrate 15 directly under via-conductor 13B. In other words, internal electrode 11B is connected to via-conductor 13B at joint portion 311B. Via-conductor 13D is provided between joint portion 311B and ceramic insulating substrate 15 and is connected to joint portion 311B and ceramic insulating substrate 15. Via-conductor 13D extends from joint portion 311B of internal electrode 11B in direction 202A opposite to via electrode 13B.

Similarly to varistor 201 of Embodiment 1, varistor section 510 is a ceramic sintered body sintered unitarily on ceramic insulating substrate 15 having a large mechanical strength, hence allowing varistor 1201 to have a small thickness and a large mechanical strength. Internal electrode 11B is not positioned directly under joint portion 311A of internal electrode 11A, thus preventing internal electrodes 11A and 11B from getting close to each other. This provides varistor 1201 with excellent characteristics and quality, and no short-circuiting failure.

Via-conductors 13C and 13D, which are connected between internal electrodes 11A and 11B and ceramic insulating substrate 15 directly under via-conductors 13A and 13B, respectively, prevent internal electrodes 11A and 11B from distortion and deformation, and allow portion 1014F of varistor layer 1014 between internal electrodes 11A and 11B to have a uniform thickness. This structure reduces variations in the electrical characteristics of varistor 1201 and provides varistor 1201 with excellent characteristics and quality.

Next, a method of manufacturing varistor 1201 will be described below. FIG. 8 is an exploded perspective view of varistor 1201. Varistor layers 1014A, 1014B, and 1014C are stacked to provide varistor layer 1014.

First, plural zinc-oxide green sheets made of ceramic powder mainly containing zinc oxide containing organic binder are prepared. Each of the green sheets has a thickness of about 30 μm. The zinc-oxide green sheets are sintered to provide varistor layers 1014A, 1014B, and 1014C.

Through-holes 1314A and 1414A are formed in the zinc-oxide green sheet to be varistor layer 1014A. Through-hole 1314A is filled with silver paste to provide via-conductor 13C. Through-hole 1414A is filled with silver paste to provide via-conductor 13D. Silver paste is screen-printed on surface 1214A of this zinc oxide green sheet to forma conductive layer to provide internal electrode 11B. This conductive layer covers through-hole 1414A. A portion of this conductive layer covering through-hole 1414A provides joint portion 311B of internal electrode 11B.

Through-holes 1314B and 1414B are formed in the zinc-oxide green sheet to be varistor layer 1014B. Through-hole 1314B is filled with silver paste to provide via-conductor 13C. Through-hole 1414B is filled with silver paste to provide via-conductor 13B. Silver paste is screen-prined on surface 1214B of this zinc-oxide green sheet to from a conductive layer to provide internal electrode 11A. This conductive layer covers through-hole 1314B. A portion of this conductive layer covering through-hole 1314A provides joint portion 311A of internal electrode 11A. Then, the zinc-oxide green sheet to be varistor layer 1014B is stacked on surface 1214A of the zinc-oxide green sheet to be varistor layer 1014A and on internal electrode 11B so that surface 1114B opposite to surface 1214B is positioned on surface 1214A.

Through-holes 1314C and 1414C are formed in the zinc-oxide green sheet to be varistor layer 1014C. Through-hole 1314C is filled with silver paste to provide via-conductor 13A. Through-hole 1414C is filled with silver paste to provide via-conductor 13B. Silver paste is screen-printed on surface 1214C of this zinc-oxide green sheet to form a conductive layer to provide external electrode 12A. This conductive layer covers through-hole 1314C. Silver paste is screen-printed on surface 1214C to form a conductive layer to provide external electrode 12B. This conductive layer covers through-hole 1414C. Then, the zinc oxide green sheet to be varistor layer 1014C is stacked on surface 1214B of the zinc oxide green sheet to be varistor layer 1014B and on internal electrode 11A so that surface 1114C opposite to surface 1214C is positioned on surface 1214B, thus providing a laminated body to provide varistor section 510.

Next, the laminated body is placed on surface 15A of ceramic insulating substrate 15 made of alumina, so that surface 1114A opposite to surface 1214A is positioned on surface 15A to provide a laminated block.

Then, the laminated block is heated in atmospheric air for removing the binder, and heated to a temperature of 930° C. in atmospheric air to be sintered unitarily, providing a sintered body. Then, glass paste is screen-printed on portion 510B of surface 510A of varistor section 510 other than portion 510C having external electrode 12A and 12B thereon, and is fired at a predetermined temperature, thus providing protective layer 26. External electrodes 12A and 12B are plated with nickel and gold, and then, the sintered body is cut into varistor 1201 having a predetermined size.

According to Embodiment 2, ceramic insulating substrate 15 has a thickness of about 180 μm. The conductive layers for providing internal electrodes 11A and 11B have thicknesses of about 2.5 μm. A large number of conductive layers are printed in rows and columns of an array so as to provide the shape shown in FIG. 7 after the sintered body is cut.

300 pieces of samples of varistor 1201 were manufactured by the above method. Each of the samples has length L2 of about 1.6 mm, width W2 of about 0.8 mm, and thickness T2 of about 0.25 mm. These samples provided no short-circuiting failure between external electrodes 12A and 12B. These samples did not cause any short-circuiting failure between external electrodes 12A and 12B. In each of these samples, a varistor voltage, a voltage between external electrodes 12A and 12B provided while a current of 1 mA flows between electrodes 12A and 12B, ranged from about 24V to about 28V. Varistor 1201 of Embodiment 2 has variations of the varistor voltage smaller than that of varistor 201 of Embodiment 1 and has characteristics and quality more excellent than that of varistor 201.

The samples of varistor 1201 prepared in above were subjected to an electrostatic discharge test with the circuit shown in FIG. 5 and evaluated similarly to varistor 201 of Embodiment 1.

A peak voltage applied to protected equipment device was about 230V while a sample of varistor 1201 was connected. This result shows that the varistor can reduces the voltage caused by the electrostatic discharge pulse sufficiently.

Each of varistors 201 and 1201 of Embodiments 1 and 2 includes a single varistor. According to requirement, the methods of manufacturing the varistor of Embodiments 1 and 2 can provide a varistor array including plural varistors within a predetermined size having a predetermined performance.

The number of each of portions 14F and 1014F between internal electrodes 11A and 11B functioning as a varistor in varistor layer 14 is one. Each of the varistors of Embodiments 1 and 2 may have more than one portion between more than two internal electrodes functioning as a varistor.

According to Embodiments 1 and 2, the alumina substrate is used as ceramic insulating substrate 15. Substrate 15 may employ ferrite and dielectric material having a high dielectric constant and having sufficient bending strengths. Silver paste is used for providing the internal electrodes, however, other metal pastes, such as silver-palladium paste and platinum paste, may be used.

According to Embodiments 1 and 2, the ceramic sintered body provided by sintering varistor layer 14 or 1014, internal electrodes 11A and 11B, and via-conductors 13A and 13B together with external electrodes 12A and 12B simultaneously. Alternatively, external electrodes 12A and 12B may be formed after the ceramic sintered body is provided by sintering varistor section 10 or 510 including varistor layer 14 or 1014, internal electrodes 11A and 11B, and via-conductors 13A and 13B.

While external electrodes 12A and 12B are plated, protective layer 16 and 26 protect varistor section 10 and 510 from plating solutions to enhance resistance to environment of varistor 201 and 1201, respectively.

According to Embodiment 1, protective layer 16 is sintered together with varistor layer 14, internal electrodes 11A and 11B, via-conductors 13A and 13B, and external electrodes 12A and 12B. This method provides protective layer 16 by a simple process.

According to Embodiment 2, protective layer 26 is formed by printing glass paste after the sintered body is fabricated by sintering varistor layer 1014, internal electrodes 11A and 11B, via-conductors 13A, 13B, 13C, and 13D, and external electrodes 12A and 12B. This method allows material of protective layer 26 to be selected from a larger number of kinds of materials.

According to Embodiments 1 and 2, external electrodes 12A and 12B are plated before varistor 201 and 1201 are cut to have the predetermined sizes. External electrodes 12A and 12B may be plated after varistor 201 and 1201 are cut.

Each of varistors 201 and 1201 of Embodiments 1 and 2 has a small thickness, a large mechanical strength, and excellent characteristics, accordingly being useful as a component for protecting a small and thin electronic device, such as a portable telephone, from breakage and malfunction caused by an electrostatic discharge pulse and a surge voltage.

What is claimed is:

1. A varistor comprising:

a ceramic insulating substrate;

a varistor section having an outer surface, the varistor section including:

a varistor layer provided on the ceramic insulating substrate, a first internal electrode provided at the varistor layer, a second internal electrode having a first portion facing the first internal electrode, the first internal electrode and the first portion of the second internal electrode sandwiching at least a portion of the varistor layer, a first via-conductor embedded in the varistor layer, the first via-conductor exposed from the varistor layer, the first via-conductor being connected to the first internal electrode, and a second via-conductor embedded in the varistor layer, the second via-conductor exposed from the varistor layer, the second via-conductor being connected to the second internal electrode;

a first external electrode provided on the outer surface of the varistor section and connected to the first via-conductor, and a second external electrode provided on the outer surface of the varistor section and connected to the second via-conductor, wherein the first internal electrode has a first joint portion connected to the first via-conductor, the second internal electrode has a second joint portion connected to the first via-conductor, and the varistor section further includes a third via-conductor embedded in the varistor layer, the third via-conductor being provided between the first joint portion and the ceramic insulating substrate as to be connected to the first joint portion and the ceramic insulating substrate, and a fourth via-conductor embedded in the varistor layer, the fourth via-conductor being provided between the second joint portion and the ceramic insulating substrate as to be connected to the second joint portion and the ceramic insulating substrate.

2. The varistor of claim 1, wherein the second internal electrode further has a second portion not facing the first internal electrode, the first internal electrode has a third portion facing the second internal electrode and has a fourth portion not facing the second internal electrode, the first via-conductor is connected to the fourth portion of the first internal electrode, and the second via-conductor is connected to the second portion of the second internal electrode.

* * * * *